US006506987B1

(12) United States Patent
Woods

(10) Patent No.: US 6,506,987 B1
(45) Date of Patent: Jan. 14, 2003

(54) MAGNETIC SWITCH

(76) Inventor: Randy Woods, 136 Valley Ranch N., Prescott, AZ (US) 86303

( * ) Notice: Subject to any disclaimer, the term of this patent is extended or adjusted under 35 U.S.C. 154(b) by 0 days.

(21) Appl. No.: 09/909,216

(22) Filed: Jul. 19, 2001

(51) Int. Cl.[7] ..... H01H 9/00

(52) U.S. Cl. ..... 200/61.62; 200/61.7; 335/207; 340/547

(58) Field of Search ..... 200/61.45 R, 61.52, 200/61.45 M, 61.62, 61.7, 61.71, 61.81, 61.82; 335/205–207; 340/547, 543.1

(56) References Cited

U.S. PATENT DOCUMENTS 5,530,428 A * 6/1996 Woods ..... 200/61.7
5,610,338 A * 3/1997 Kato et al. ..... 200/61.45 R
5,880,659 A * 3/1999 Woods ..... 200/61.7
5,977,873 A * 11/1999 Woods ..... 335/205

* cited by examiner

*Primary Examiner*—Michael Friedhofer

(74) *Attorney, Agent, or Firm*—Hovey Williams LLP

(57) ABSTRACT

An improved magnetic switch (10) is provided which is designed for use in an alarm circuit (52) in order to detect relative movement between first and second members such as a door (14) and frame (12), so as to signal unauthorized opening of the door (14). The switch (10) includes a switch assembly for mounting in frame (12) and having first and second switch elements (40, 42), a permanently magnetized, shiftable body (44) adjacent the elements (40,42), and a first attractive component (36). Additionally, the switch (10) has a second attractive component (22) for mounting to the door (14), which is in the form of a ferromagnetic component such as a permanent magnet (50) or steel plate (60). In use when door (14) is closed and circuit (52) is armed, the magnetic attraction between body (44) and component (22) shifts the body (44) to a switch-closed position in simultaneous contact with the switch elements (40, 42). If the door (14) is opened, the magnetic attraction between body (44) and component (36) moves the body to a switch-open position out of simultaneous contact with the switch elements (40, 42), thus triggering circuit (52). If an intruder attempts to defeat the switch (10) through an external magnet (58), this again moves the body (44) to a switch-open position, triggering the circuit (52).

19 Claims, 1 Drawing Sheet

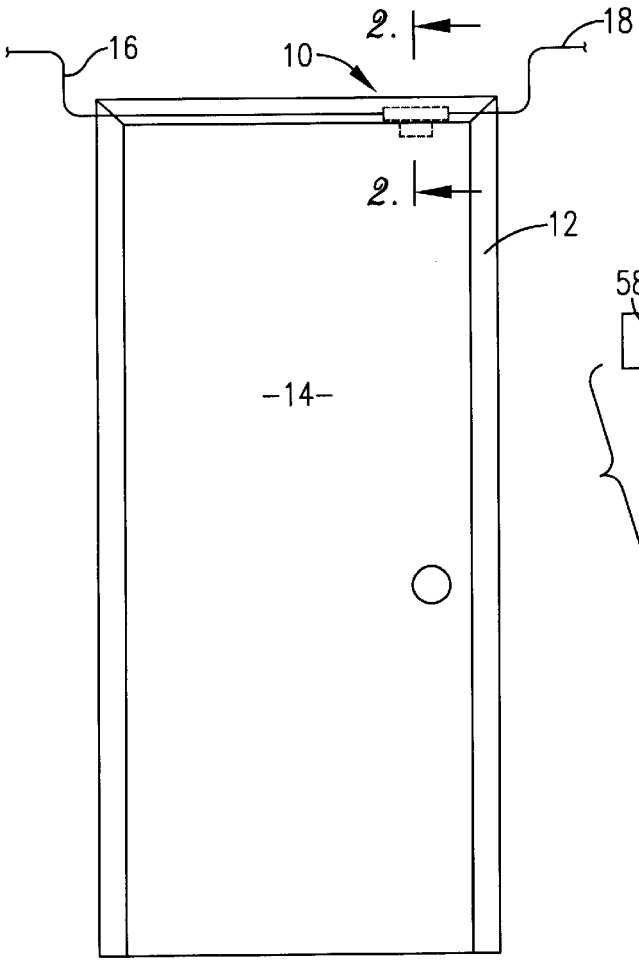
FIG. 1.
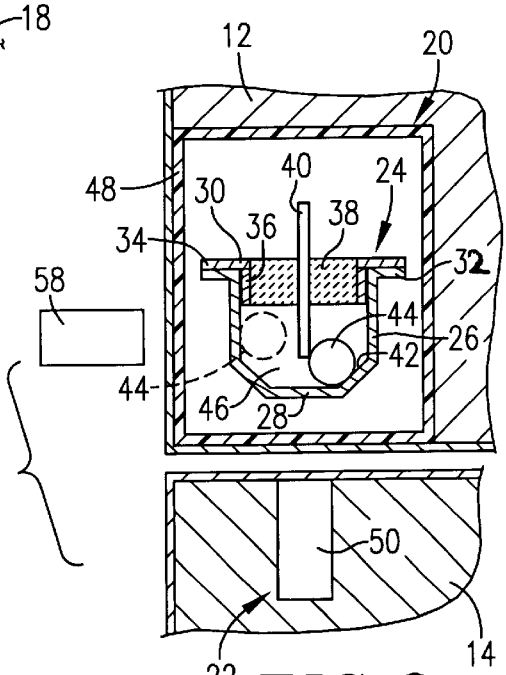
FIG. 2.
FIG. 3.
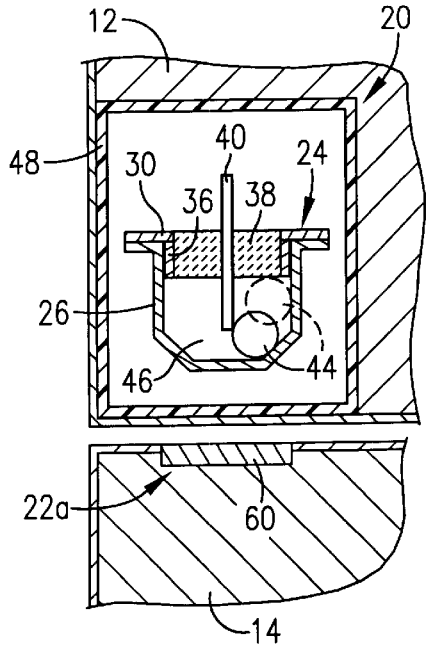
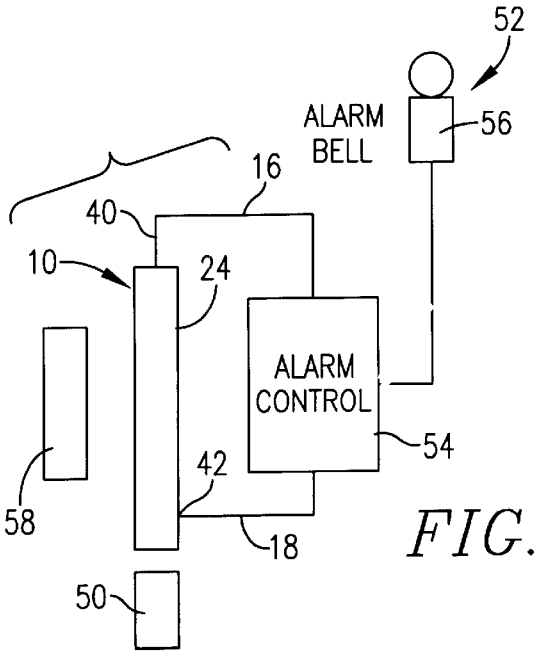
FIG. 4.

MAGNETIC SWITCH

BACKGROUND OF THE INVENTION

1. Field of the Invention

The present invention is broadly concerned with magnetic switches of the type used as a part of alarm systems for detective relative movement between first and second structural members such as a door and door frame or a window and window frame. More particularly, the invention is concerned with such switches which are especially designed to defeat attempted unauthorized external magnetic manipulation thereof. The magnetic switches of the invention include first and second spaced apart electrically conductive switch elements typically within an enclosed housing and including a permanently magnetized body adjacent the contacts which can be shifted by virtue of magnetic attractions between a first switch-closed position where the body simultaneously contacts both of the switch elements, and a switch-open position where the body is out of contact with both of the switch elements.

2. Description of the Prior Art

Prior art security alarm systems often make use of magnetic switches attached to doors and windows and integrated with the system for detecting unauthorized openings. One common type of magnetic switch used in these situations is a so-called reed switch. It has been found that reed switches are subject to unauthorized manipulation through use of an external magnet. Specifically, an intruder can hold a relatively strong magnet adjacent the reed switch which will then be operated (to either open or close depending on the control scheme). With this accomplished, an intruder can open the door or window without triggering the alarm system.

A number of magnetic switches have been proposed in the past to overcome the inherent deficiencies of reed switches. U.S. Pat. Nos. 5,997,873, 5,530,428, 5,332,992, 5,673,021, and 5,880,659 describe switches of this type.

SUMMARY OF THE INVENTION

The present invention is directed to improved magnetic switches for detecting relative movement between first and second members such as doors/door frames or windows/window frames, and normally are used to detect when one of the members is moved from a first position in close adjacency with the second member, to a second position where the one member is moved to a separated open position. Broadly speaking, the magnetic switches of the invention include a switch assembly for mounting to the first member and having first and second switch elements in spaced relationship to each other, an electrically conductive permanently magnetized body shiftable between a first body position where the body is in simultaneous contact with both of the switch elements, and a second body position where the body is out of contact with both of the switch elements. The switch assembly also includes a first magnetically attractive component adjacent the contacts in the first structural member and a second magnetically attractive component for mounting to the second member. Importantly, the first and second attractive components are selected and located so that, when the first and second structural members are in the first, adjacent position, the body will be shifted to a position in simultaneous contact with said first and second switch elements by virtue of a magnetic attraction between the body and the second attractive component; moreover, when the first and second members are in the second, separated position, the body will be shifted to a position out of contact with both of said switch elements by virtue of a magnetic attraction between the body and the first attractive component.

In preferred forms, the switch assembly includes a housing presenting a closed, hermetically sealed chamber defined by a circumscribing sidewall, a concavo-convex bottom wall and a top cover. The top cover includes a relatively weak first attractive component, whereas the bottom wall has a contact surface which defines the second switch element. An elongated, electrically conductive electrode extends downwardly through the top cover and into the chamber, and effectively defines the first switch element. The shiftable body is preferably in the form of a substantially spherical ball formed of permanently magnetized material such as a samarium-cobalt alloy having an external coating of nickel.

The second attractive component for attachment to the second structural member is preferably formed of ferromagnetic material, and may be either a relatively strong permanent magnet or a ferromagnetic plate.

BRIEF DESCRIPTION OF THE DRAWINGS

FIG. 1 illustrates a preferred magnetic switch in accordance with the invention, depicted in use for protecting a door;

FIG. 2 is a vertical sectional view taken along line 2—2 of FIG. 1 and depicting the construction and operation of the preferred magnetic switch;

FIG. 3 is a vertical sectional view similar to that of FIG. 2, but illustrating a modified switch; and FIG. 4 is a schematic depiction of a preferred alarm system using the preferred magnetic switch device of the invention.

DETAILED DESCRIPTION OF THE PREFERRED EMBODIMENT

Turning now to the drawing, FIG. 1 illustrates a magnetic switch 10 (dashed lines) shown in use with a door frame 12 and door 14. Appropriate electrical leads 16, 18 are operatively coupled with the switch 10 as will be described below in more detail.

The switch 10 includes a switch assembly 20 designed to be secured to frame 12, as well as a second attractive component 22 which is mounted to door 14. The switch assembly 20 in preferred forms includes a housing 24 having a circumscribing annular sidewall 26, an integral concavo-convex bottom wall 28 and atop cover 30. Preferably, the integral sidewall and bottom wall 26,28 presents a circumscribing flange 32 and is formed of a suitable electrically conductive stainless steel such as 304. The top cover 30 includes an outboard flange 34 adapted to mate with flange 32, an inner annular first attractive component 36, and a central glass or ceramic nonconductive plug 38. The flange 34 is preferably formed of stainless steel, whereas the component 36 is made of partially annealed stainless steel.

The assembly 20 also includes an elongated, depending, substantially upright first switch element 40 which as shown extends downwardly through plug 36 to a point spaced above bottom wall 28, the latter having an annular contact surface 42 which serves as the second switch element.

A shiftable body 44 is located within housing 24 and is formed of permanently magnetized material. Preferably, this material is an appropriate samarium-cobalt alloy with a thin (usually about 0.001–0.002") outer coating of nickel for wear purposes. Preferred configurations of body 44 include substantially spherical balls as well as cylinders.

The top cover 30 is welded to sidewall 26 at the facing contact between the flanges 32 and 34, thereby creating a hermetically sealed internal chamber 46. It is preferred that the chamber 46 be filled with an inert gas such as argon.

As illustrated in FIG. 2, the housing 24 may be located within a mounting box 48 positioned within an appropriately sized recess in frame 12. However, such a mounting arrangement is not essential.

The second attractive component 22 is mounted to door 14 and in the embodiment illustrated is in the form of a relatively strong permanent magnet 50. When the door 14 is closed relative to frame 12, it will be seen that the magnet 50 is directly below housing 24. Obviously, when the door 14 is opened, the magnet 50 is shifted away from the housing 24.

FIG. 4 illustrates a conventional hookup of switch 10 within an alarm circuit 52. In particular, the housing 24 is electrically coupled with a conventional alarm control 54, that is lead 16 is operatively coupled with first switch element 40 and lead 18 is coupled with the second switch element 42, with both leads connected to control 54. An alarm bell 56 or similar output device is connected with control 54.

Attention is again directed to FIG. 2 which illustrates the operation of switch 10. In the FIG. 2 orientation, the door 14 is closed relative to frame 12. In this orientation, the body 44 is shifted to a first position (shown in full line) by virtue of the magnetic attraction between body 44 and magnet 50, so that the body is in simultaneous electrical contact with both of the switch elements 40, 42, in a switch-closed position. However, if the door 14 is opened, the magnet 50 passes out of operative relationship with the body 44, and the latter is quickly moved upwardly under the influence of the magnetic attraction between the weak component 36 and the body. In this position, the body 44 is held out of contact with both of the switch elements and is thus in a switch-open position. The alarm control 54 is configured so that if the circuit 52 is armed, such opening of the door 14 and consequent movement of body 44 to the switch-open position will trigger the alarm.

As also shown in FIG. 2, if an intruder attempts to use an external magnet 58 in an attempt to defeat switch 10, the body 44 is moved because of the magnetic attraction between the magnet 58 and the body to the dashed line position, which again is a switch-open orientation serving to trigger the alarm circuit 52. Consequently, any such attempt to defeat the switch 10 will immediately set off the alarm.

FIG. 3 illustrates a modified embodiment in accordance with the invention which makes use of the identical switch assembly 20 but a modified second attractive component 22*a*. In this case, the component 22*a* is simply a stainless steel plate 60 which is affixed to the upper margin of door 14 below the housing 24 when the door is closed. In this case, when the door 14 is closed the body 44 is shifted downwardly to the switch-closed position under the influence of the magnetic attraction between the body 44 and the plate 60. When the door is opened, the body 44 is shifted upwardly to the switch-open position by virtue of the magnetic attraction between the body 44 and the first attractive component 36.

It will be appreciated that the relative strengths or magnetic susceptibilities of the first and second components 36, 22 must be considered in the design of switch 10. That is, the magnetic attraction generated between the body 44 and magnet 50 or plate 60 when the door 14 is closed must be significantly stronger than the countervailing magnetic attraction between the body 44 and the component 36. In practice, it has been found that the steel component 36, if partially annealed, loses enough of its magnetic attractive qualities to properly work in the context of switch 10.

I claim:

1. A magnetic switch for detecting relative movement between first and second members, said switch comprising:

a switch assembly for mounting to the first member, including a first elongated switch element, a second switch element in spaced relationship to the first element, an electrically conductive permanently magnetized body, and a first attractive component, said body shiftable between a first position where the body is in simultaneous contact with said first and second switch elements, and a second position where the body is out of contact with both of the switch elements; and a second attractive component for mounting to said second member, said first and second attractive components being located so that, when the first and second members are in an initial relative orientation, said body will be shifted to said first position by virtue of a magnetic attraction between said body and said second attractive component, and so that, when the first and second members are in another, different relative orientation, said body will be shifted to said second position by virtue of a magnetic attraction between said body and said first component.

2. The switch of claim 1, said first attractive component formed of partially annealed steel.

3. The switch of claim 2, said switch assembly including a closed housing having a cover, said first attractive component being an annular body forming a part of said cover.

4. The switch of claim 2, said cover including a central nonconductive plug.

5. The switch of claim 1, said second attractive component comprising a ferromagnetic component.

6. The switch of claim 5, said ferromagnetic component being a permanent magnet.

7. The switch of claim 1, said body comprising a substantially spherical ball.

8. The switch of claim 7, said ball formed of a samarium-cobalt alloy.

9. The switch of claim 8, said alloy having an external coating of nickel.

10. The switch of claim 1, said first switch element presenting an elongated, rod-like configuration which is oriented in a substantially upright manner, said second switch element being substantially disc-like with the second switch element disposed below the first switch element and generally transverse to the longitudinal axis of the first switch element.

11. The switch of claim 10, said second switch element presenting a concave surface adjacent said first switch element.

12. A magnetic switch for detecting relative movement between first and second members when the members are moved from a first, substantially adjacent position to a second position where the members are separated, said switch comprising:

a switch assembly for mounting to the first member, including housing presenting a chamber with a circumscribing sidewall, a concavo-convex bottom wall, and a top cover, said top cover including a relatively weak first attractive component, said bottom wall having a contact surface;

an elongated, electrically conductive element extending downwardly through said top cover and into said chamber, said elongated element and said contact surface defining first and second switch elements, respectively; and a shiftable body within said chamber and formed of permanently magnetized material; and a second attractive component for coupling to said second member, said first and second attractive components being selected and located so that, when the first and second members are in said first, adjacent position, said body will be shifted to a position in simultaneous contact with said first and second switch elements by virtue of a magnetic attraction between said body and said second attractive component, and so that, when the first and second members are in said second, separated position, said body will be shifted to a position out of contact with both of said switch elements by virtue of a magnetic attraction between said body and said first component.

13. The switch of claim 12, said second attractive component comprising a ferromagnetic component.

14. The switch of claim 13, said ferromagnetic component being a permanent magnet.

15. The switch of claim 13, said second attractive component being a metallic plate.

16. The switch of claim 12, said body formed of a samarium-cobalt alloy.

17. The switch of claim 16, said alloy having an external coating of nickel.

18. The switch of claim 12, said chamber having an inert gas atmosphere.

19. The switch of claim 12, said body comprising a substantially spherical ball.

* * * * *